US010665365B2

(12) United States Patent
Gatu et al.

(10) Patent No.: US 10,665,365 B2
(45) Date of Patent: May 26, 2020

(54) LOW VOLTAGE ELECTRIC POWER CABLE

(71) Applicant: NKT Cables Group A/S, Brøndby (DK)

(72) Inventors: Anders Jonas Gatu, Vikarbyn (SE); Jan Roger Erikers, Falun (SE)

(73) Assignee: NKT Cables Group A/S, Brøndby (DK)

( * ) Notice: Subject to any disclaimer, the term of this patent is extended or adjusted under 35 U.S.C. 154(b) by 0 days.

(21) Appl. No.: 16/115,116

(22) Filed: Aug. 28, 2018

(65) Prior Publication Data

US 2019/0074107 A1 Mar. 7, 2019

(30) Foreign Application Priority Data

Sep. 5, 2017 (EP) ..... 17189321

(51) Int. Cl.

| | |
|---|---|
| ***H01B 7/00*** | (2006.01) |
| ***H01B 9/00*** | (2006.01) |
| ***H01B 7/18*** | (2006.01) |
| ***H01B 13/10*** | (2006.01) |
| *H01B 7/04* | (2006.01) |
| *H01B 7/22* | (2006.01) |

(52) U.S. Cl.

CPC ..... *H01B 9/006* (2013.01); *H01B 7/1885* (2013.01); *H01B 7/1895* (2013.01); *H01B 13/103* (2013.01); *H01B 7/04* (2013.01); *H01B 7/221* (2013.01)

(58) Field of Classification Search

CPC ..... H01B 7/02; H01B 7/1885; H01B 7/1895; H01B 7/221; H01B 7/04; H01B 13/103

USPC ..... 174/102 R, 103, 108, 109, 110 R, 112, 174/113 R, 115, 116, 117 R

See application file for complete search history.

(56) References Cited

U.S. PATENT DOCUMENTS

| | | | | |
|---|---|---|---|---|
| 3,032,604 A * | 5/1962 | Timmons | H01B 11/1016 | 174/115 |
| 4,096,346 A * | 6/1978 | Stine | F16L 11/06 | 174/36 |
| 4,378,299 A * | 3/1983 | Alexander | C10M 173/02 | 508/219 |
| 5,329,065 A * | 7/1994 | Marney | H01B 7/04 | 174/113 R |
| 6,259,019 B1 * | 7/2001 | Damilo | H01B 11/1016 | 174/102 R |

(Continued)

FOREIGN PATENT DOCUMENTS

EP 2431980 A2 3/2012

OTHER PUBLICATIONS

European Search Report Application No. EP17189321 Completed: Feb. 2, 2018;dated Feb. 12, 2018 9 pages.

(Continued)

*Primary Examiner* — William H. Mayo, III

(74) *Attorney, Agent, or Firm* — Whitmyer IP Group LLC

(57) ABSTRACT

A low voltage electric power cable includes at least two insulated conductors arranged together in a bundle, at least one foil extending around the bundle, and an outer sheath extending around the at least one foil. A recess is formed between two insulated conductors. The low voltage electric power cable includes an elongated member, the elongated member being arranged between the at least one foil and the outer sheath, and extending adjacent to the at least one foil along the recess. The elongated member is arranged with a clearance fit underneath the outer sheath.

20 Claims, 3 Drawing Sheets

(56) References Cited

U.S. PATENT DOCUMENTS

| | | | | |
|---|---|---|---|---|
| 6,444,902 | B1 * | 9/2002 | Tsao | H01B 7/0861 174/113 R |
| 6,486,395 | B1 * | 11/2002 | Temblador | H01B 9/02 174/102 R |
| 6,630,624 | B2 * | 10/2003 | Tsao | H01B 7/0861 174/113 R |
| 7,166,802 | B2 * | 1/2007 | Cusson | H01B 7/20 174/105 R |
| 8,039,749 | B2 * | 10/2011 | Okano | H01B 11/1008 174/113 R |
| 8,124,875 | B2 * | 2/2012 | Aitken | H01B 9/028 174/102 R |
| 8,378,217 | B2 * | 2/2013 | Sugiyama | H01B 11/203 174/113 R |
| 2007/0032721 | A1 * | 2/2007 | Crane | A61B 5/0059 600/407 |
| 2008/0007878 | A1 * | 1/2008 | Gandolfi | H01B 9/028 361/42 |
| 2009/0260847 | A1 * | 10/2009 | Tobben | H01B 11/203 174/107 |
| 2010/0186987 | A1 | 7/2010 | Aitken et al. | |
| 2017/0103830 | A1 | 4/2017 | Dettmer et al. | |

OTHER PUBLICATIONS

European Office Action Application No. 17 189 321.7 Completed: Feb. 18, 2020 8 pages.

* cited by examiner

LOW VOLTAGE ELECTRIC POWER CABLE

TECHNICAL FIELD

The invention relates to a low voltage electric power cable.

BACKGROUND

An electric power cable comprises at least one electrical conductor which is surrounded by an insulating material. An outer jacket surrounds the at least one electrical conductor. Further cable members may be arranged underneath the outer jacket, such as an electrical shielding, enforcing wires, etc.

Low voltage electric power cables are utilised in various different electric power distribution applications. A voltage of up to 1 kV is referred to as a low voltage in connection with electric power cables and power distribution.

Suitably an electric power cable is bendable in order to facilitate handling of the electric power cable, at least prior to and during installation of the electric power cable. Traditionally, a low voltage power cable is provided with twisted conductors and a shield wire made from braided wires or wires twisted around the conductors.

EP 2431980 is concerned with improved roundness and improved bending capabilities in a cable. The cable includes a shell comprising a tube-shaped tape of a material selected from a group of materials consisting of cellulose, synthetic resin or a combination thereof, a sheath of synthetic resin enclosing the shell, and a cable body comprising twisted conductors inside the shell. The shell has a resilience capable of yieldably resisting a compressive force from the sheath when the sheath is shrinking during forming thereof, to thereby maintain a predetermined clearance to the cable body and/or a resulting roundness of the sheath once the sheath has been hardened.

SUMMARY

It is an object of the present disclosure to provide an alternative low voltage electric power cable which is bendable.

According to an aspect of the invention, the object is achieved by a low voltage electric power cable having a length L and comprising at least two insulated conductors arranged together in a bundle, at least one foil extending around the bundle, and an outer sheath extending around the at least one foil. Each of the at least two insulated conductors comprises a conductive core and an outer electrically insulating layer. The at least two insulated conductors are arranged adjacent to each other along the length L. A recess is formed between two adjacent insulated conductors of the at least two insulated conductors, the recess extending in parallel with the two adjacent insulated conductors along the length L. The low voltage electric power cable comprises an elongated member, the elongated member being arranged between the at least one foil and the outer sheath, and extending adjacent to the at least one foil along the recess, wherein the elongated member is arranged with a clearance fit underneath the outer sheath. The at least one foil is slidable in relation to the at least two insulated conductors in a radial direction of the cable.

Since the low voltage electric power cable comprises an elongated member, the elongated member being arranged between the at least one foil and the outer sheath, and extending adjacent to the at least one foil along the recess, and since the elongated member is arranged with a clearance fit underneath the outer sheath, the outer sheath is arranged loosely around the at least two insulated conductors. Thus, during bending of the low voltage electric power cable, friction between the at least two insulated conductors, and between the outer sheath and the elongated member is low. Accordingly, the low voltage electric power cable is more easily bent than an electric power cable wherein the outer sheath is snuggly fit around the insulated conductors.

The at least one foil being slidable in relation to the at least two insulated conductors in a radial direction of the cable achieves the clearance fit between the elongated member and the outer sheath during manufacturing of the low voltage electric power cable, see further below.

The low voltage electric power cable may be configured for distribution of electric power of up to 1 kV. For instance, the low voltage electric power cable may be utilised for supplying electric power to mobile communication equipment, such as e.g. a mobile communication base station, and/or for distributing electric power to domestic or commercial buildings. The low voltage electric power cable may comprise e.g. two insulated conductors, or three insulated conductors. The insulated conductors may be form phase conductors in a cable for AC power, or they may form conductors of a cable for DC power. One insulated conductor may form a neutral conductor.

The at least one foil may enclose the entire bundle in a circumferential direction of the cable. Alternatively, the at least one foil may extend around the bundle with a circumferential gap. In embodiments with two or more foils, the two or more foils may be circumferentially arranged next to each other to extend around the bundle, overlapping or with gaps in between the foils.

The elongated member extends along the entire length L of the cable. A purpose of the elongated member may be to provide for achieving the clearance fit within the outer shell. The elongated member may be utilised for further purposes, such as e.g. as a shield wire within the low voltage electric power cable.

The term "clearance fit" is a well-defined term used with the mechanical field. A radial direction of the cable extends substantially perpendicularly to the length of the cable. That is, the radial direction extends from a centre of the cable towards the outer sheath or vice versa. The at least one foil being slidable in relation to the at least two insulated conductors means that at least a portion of the at least one foil is movable within the cable.

According to embodiments, the at least one foil may comprise at least one metal layer. In this manner, the at least one foil may form an electric shield of the low voltage electric power cable.

According to embodiments, the elongated member may comprise at least one metal wire. In this manner, the elongated member may form a shield wire. Together with the at least one foil comprising at least one metal layer, the elongated member comprising at least one metal wire may form an electric shield of the low voltage electric power cable.

Further features of, and advantages with, the invention will become apparent when studying the appended claims and the following detailed description.

BRIEF DESCRIPTION OF THE DRAWINGS

Various aspects and/or embodiments of the invention, including its particular features and advantages, will be readily understood from the example embodiments discussed in the following detailed description and the accompanying drawings, in which.

DETAILED DESCRIPTION

Aspects and/or embodiments of the invention will now be described more fully. Like numbers refer to like elements throughout. Well-known functions or constructions will not necessarily be described in detail for brevity and/or clarity.

Figure 1A:
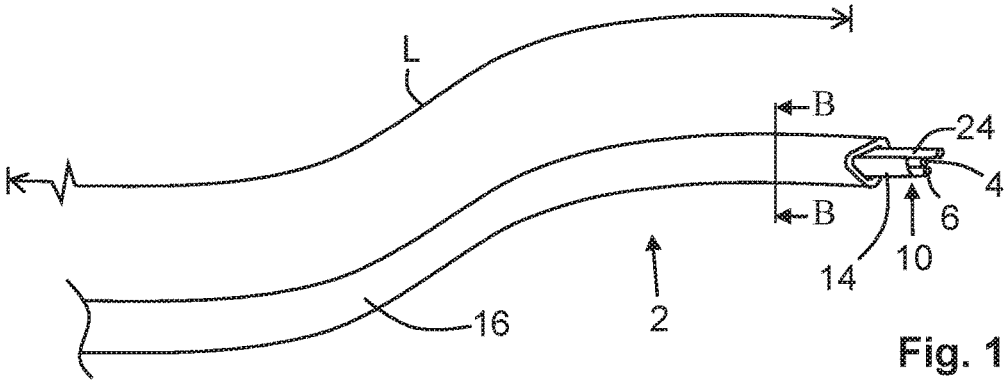
FIGS. 1*a*-1*f* schematically illustrate a low voltage electric power cable according to embodiments, FIGS. 2*a* and 2*b* schematically illustrate a low voltage electric power cable according to embodiments, and FIGS. 3*a*-3*e* schematically illustrate cross sections through low voltage electric power cables according to various embodiments.
Figure 1B:
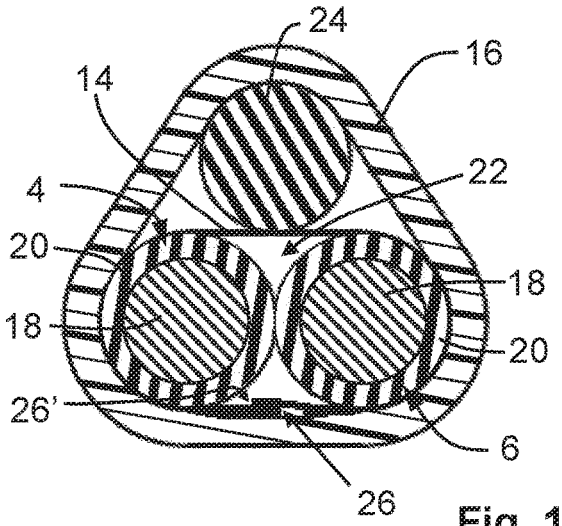
Figure 1C:
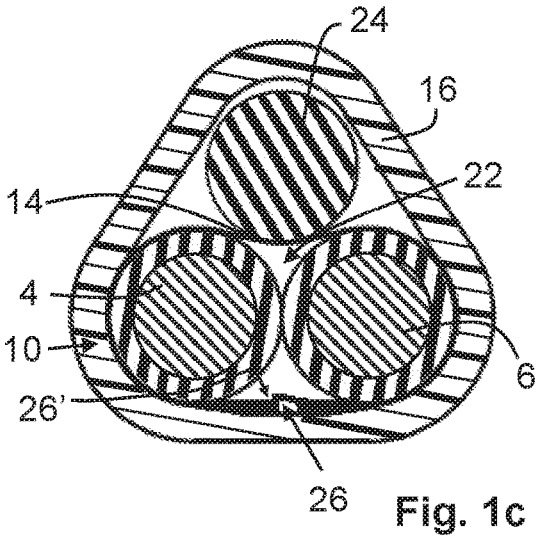
Figure 1D:
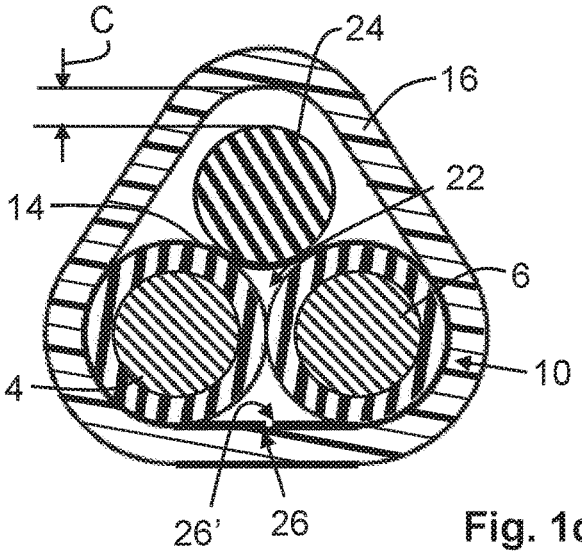
Figure 1E:
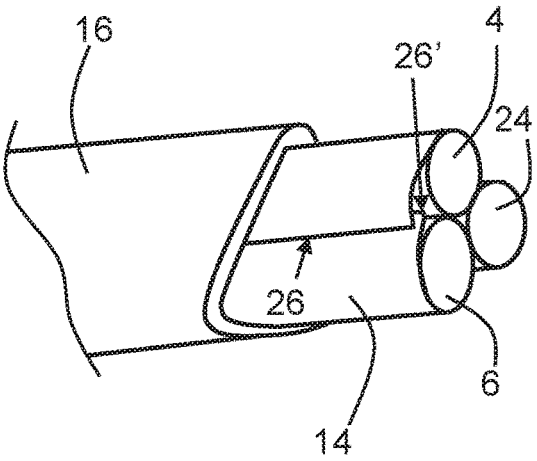
Figure 1F:
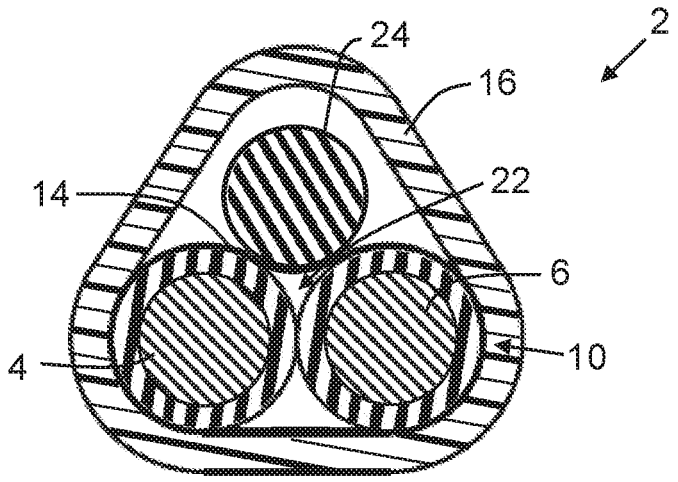

FIGS. 1*a*-1*fe* schematically illustrate a low voltage electric power cable according to embodiments. FIG. 1*a* shows a side view, and FIGS. 1*b*-1*d* show a cross section along line B-B in FIG. 1*a*, of the low voltage electric power cable 2. FIG. 1*e* shows an end portion of the low voltage electric power cable 2. Herein the low voltage electric power cable 2 may alternative be referred to as the cable 2. FIG. 1*f* shows a cross section along line B-B in FIG. 1*a*, of a low voltage electric power cable 2 according to different embodiments than in FIGS. 1*b*-1*d*.

The low voltage electric power cable 2 has a length L. The length L extends along a longitudinal extension of the cable 2. The low voltage electric power cable 2 comprises two insulated conductors 4, 6. The insulated conductors 4, 6 are arranged adjacent to each other along the length L. The insulated conductors 4, 6 are arranged together in a bundle 10. A foil 14 extends around the bundle 10. An outer sheath 16 extends around the foil 14.

Each of the insulated conductors 4, 6 comprises a conductive core 18 and an outer electrically insulating layer 20. The conductive core 18 may have a cross-sectional area within a range of e.g. 1.5-70 $mm^2$, or 2.5-70 $mm^2$, or 2.5-50 $mm^2$. The conductive core 18 may comprise e.g. aluminium and/or copper. The conductive core 18 may comprise one wire only, or a number of wires arranged together. A recess 22 is formed between the two adjacent insulated conductors 4, 6. The recess 22 is a consequence of the cross-sectional shape of the insulated conductors 4, 6. In these embodiments, the insulated conductors 4, 6 have a substantially circular cross-sectional shape. Accordingly, the recess 22 extends in parallel with the two adjacent insulated conductors 4, 6 along the length L. Also, other cross-sectional shapes of the insulated conductors, such as e.g. an oval shape, entail that a recess is formed between two adjacent insulated conductors.

The low voltage electric power cable 2 comprises an elongated member 24. The elongated member 24 is arranged between the foil 14 and the outer sheath 16. The elongated member 24 extends adjacent to the foil 14 along the recess 22. The elongated member 24 is arranged with a clearance fit underneath the outer sheath 16.

The elongated member 24 being arranged with a clearance fit underneath the outer sheath 16, may mean that also the bundle 10 within the foil 14 may be arranged with a clearance fit underneath the outer sheath 16.

Due to the clearance fit, the low voltage electric power cable 2 is easily bendable. Mainly the bending resistance of the components inside the outer sheath 16, i.e. the insulated conductors 4, 6 and the elongated member 24, determine the bending resistance of the low voltage electric power cable 2. Friction between the components inside the outer sheath 16 is low because of the clearance fit thus, frictional forces do not affect the bending resistance, or only affect the bending resistance to a very limited degree. The clearance fit may also provide an easy peeling of the outer sheath 16 from the cable 2. Namely, the clearance fit provides a lower peeling force than in a cable having a tight fitting outer sheath.

Suitably, the outer sheath 16 may be produced by tube extrusion. Briefly, cable sheaths are produced substantially by two different methods, compression extrusion and tube extrusion. In forming a sheath by compression extrusion, a high pressure is applied to the plastic material so that when extruding the plastic material onto the cable body, irregularities in or on the cable body, such as recess between insulated conductors, are filled by the plastic material, at least to some extent. In tube extrusion, another type of tool is selected for the extrusion, which tool forms a loose-fitting tube around the cable body. The tube may be extruded with a smaller extrusion rate than the pulling rate of the cable body. In this way, the tube is stretched out and settles down around the cable body in a form-stable manner.

In a more generalised sense, the low voltage electric power cable 2 may comprise at least two insulated conductors arranged together in a bundle, at least one foil may extend around the bundle, and one or more further elongated members may extend between the at least one foil and the outer sheath along the recess and/or further recesses formed between adjacent insulated conductors. Further embodiments will be discussed below with reference to FIGS. 2*a*-3*d*.

According to embodiments, a clearance, C, between the elongated member 24 and the outer sheath 16 may be at least 0.05 mm when the elongated member 24 abuts against the at least one foil 14 and is supported against each of the two adjacent insulated conductors 4, 6 of the at least two insulated conductors 4, 6.

Small diameter cables may have smaller clearance than larger diameter cables. A large diameter cable may have a considerably larger clearance than stated above, mentioned purely as an example, the clearance may be 1 mm or more mm. Already a small clearance brings about the advantage with an easily bending cable. However, at least to some extent, increasing a clearance will provide a more easily bendable cable, at least when considering small clearances. Too large a clearance may be negative. For instance, the different components of a short length of cable may separate, or fall apart, if the clearance is too large. The desired flexibility of a particular cable may determine the actual clearance chosen. The clearance size may be adjusted during manufacturing. For instance, the size of the elongated member 24, and/or the number of elongated members may be chosen for adjusting the clearance C within a particular cable. Also, the foil 14 may be less tight over the recess 22 before the outer sheath 16 is applied. The latter may be achieved by partially pressing the elongated member 24 into the recess 22 prior to applying the outer sheath 16.

Referring to FIG. 1*d*, the clearance C between the elongated member 24 and the outer sheath 16 may be measured when the elongated member 24 is arranged adjacent to the bundle 10. More specifically, at the recess 22, the elongated member 24 is positioned against the two insulated conductors 4, 6 with the foil 14 therebetween. The bundle 10 together with the elongated member 24 are position towards the outer sheath 16 in a direction opposite to where the elongated member 24 is arranged adjacent to the bundle 10. This position of the bundle 10 and the elongated member 24 is shown in FIG. 1*d*.

Referring to FIGS. 1*b*-1*d*, suitably, the at least one foil 14 is slidable in relation to the at least two insulated conductors 4, 6. Thus, the clearance fit between the elongated member 24 and the outer sheath 16 may be achieved during manufacturing of the low voltage electric power cable 2, as the foil 14 slides in relation to the insulated conductors 4, 6.

During an initial step of manufacturing the low voltage power electric power cable 2, the at least one foil 14 is arranged stretched tight around the bundle 10 and thus, stretched over the recess 22. Thereafter the elongated member 24 is positioned against the tight foil 14 and the outer sheath 16 is applied. There is an overlap of edges 26, 26' of the at least one foil 14 in a circumferential direction of the cable 2 when the foil of 14 is stretched tight around the bundle 10, see FIG. 1*b*. Due to the at least one foil 14 being slidable in relation to the at least two insulated conductors 4, 6 the at least one foil 14 will slide in a radial direction of the cable 2 during later steps of in the manufacturing when the low voltage electric power cable 2 is bent in one or more different directions. The position of the elongated member 24 at the recess 22 leads to the at least one foil 14 and the elongated member 24 sliding into the recess 22. The overlap of edges 26, 26' is reduced gradually as the elongated member 24 moves into the recess 22, see FIGS. 1*c* and 1*d*. In FIGS. 1*b*-1*d* the edges 26, 26' have been greatly exaggerated to improve visibility.

According to some embodiments, the edges 26, 26', of the at least one foil 14 are arranged circumferentially overlapping, as shown in FIG. 1*e*. That is, the at least one foil 14 encloses the entire bundle 10 in a circumferential direction of the cable 2. Alternatively, the at least one foil 14 may extend around the bundle 10 with a circumferential gap between the edges 26, 26', as shown in FIG. 1*d*. A further alternative, would be that the edges 26, 26' abut against each other. The positions of the edges 26, 26' in relation to each other are defined in the cable 2 after completion of manufacturing, i.e. as shown in FIGS. 1*d* and 1*e*. In embodiments with two or more foils, the two or more foils may be circumferentially arranged next to each other to extend around the bundle, with overlapping edges, with gaps in between edges, or with abutting edges.

According to embodiments, edges 26, 26' of the at least one foil 14 may extend in parallel with the at least two insulated conductors 4, 6. In this manner, the at least one foil 14, slidably arranged in relation to the at least two insulated conductors 4, 6, may slide in a radial direction of the low voltage electric power cable into the recess 22. Since the edges 26, 26' of the at least one foil 14 thus, extend at the same distance from the recess 22 along the length L of the low voltage electric power cable 2, the radial sliding of the at least one foil 14 into the recess 22 may readily take place during manufacturing of the low voltage electric power cable 2. In FIG. 1*e* the low voltage electric power cable 2 is shown with a portion of the outer sheath 16 remove to illustrate how one the edge 26, 26' of the at least one foil 14 extend in parallel with the insulated conductors 4, 6.

In FIG. 1*f* there are illustrated embodiments of the low voltage electric power cable 2 wherein the at least one foil 14 forms a longitudinally sealed tube, and wherein the at least one foil 14 is plastically deformed. In a low voltage electric power cable 2 according to these embodiments, the clearance fit of the elongated member 24 underneath the outer sheath 16 is achieved by forming the plastic deformation of the at least one foil 14 during manufacturing of the low voltage electric power cable 2.

More specifically, the at least one foil 14 is arranged stretched tight around the bundle 10 comprising the insulated conductors 4, 6 and thus, stretched over the recess 22. Edges of the at least one foil 14 are sealed against each other to form the longitudinally sealed tube. That is, the tube is only open at the respective ends of the cable 2. Thereafter the elongated member 24 is positioned against the tight foil 14 and the outer sheath 16 is applied. A pressure is applied against the cable 2 such that the elongated member 24 is pressed into the recess 22. The pressure is applied to such an extent that the at least one foil 14 is plastically deformed. Thus, the clearance between the elongated member 24 and the outer sheath 16 is produced. Mentioned purely as an example, a remaining plastic deformation of the at least one foil 14 of at least 1% may produce a clearance between the elongated member 24 and the outer sheath 16.

According to these embodiments, the at least two insulated conductors 4, 6 extend in parallel with each other and the length L. That is, the at least two insulated conductors 4, 6 extend straight along the entire length L of the low voltage electric power cable 2. Accordingly, the at least two insulated conductors 4, 6 are not twisted about each other. This also means that the edges 26, 26' of the at least one foil 14 extend straight along the entire length of the cable 2.

According to embodiments, the elongated member 24 may be formed of an electrically insulating material. Mentioned purely as an example, the electrically insulating material may comprise e.g. a polymer, rubber, yarn, or paper. In such embodiments, a purpose of the elongated member 24 may be to achieve the clearance fit of the components within the outer sheath 16. A further purpose may be to lend the cable a particular cross-sectional shape, which e.g. resembles a circular shape, or a triangular shape. Such different cross-sectional shapes may sometimes be desirable in a cable, e.g. in order to provide a seal against the cable when it is to extend through an opening.

Figure 2A:
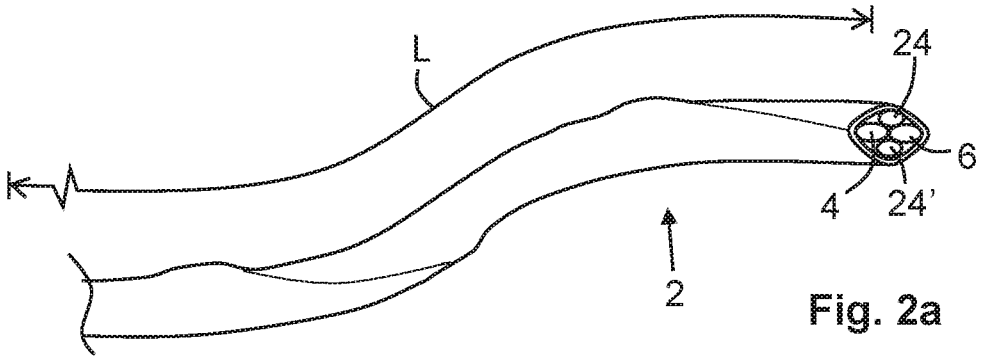
Figure 2B:
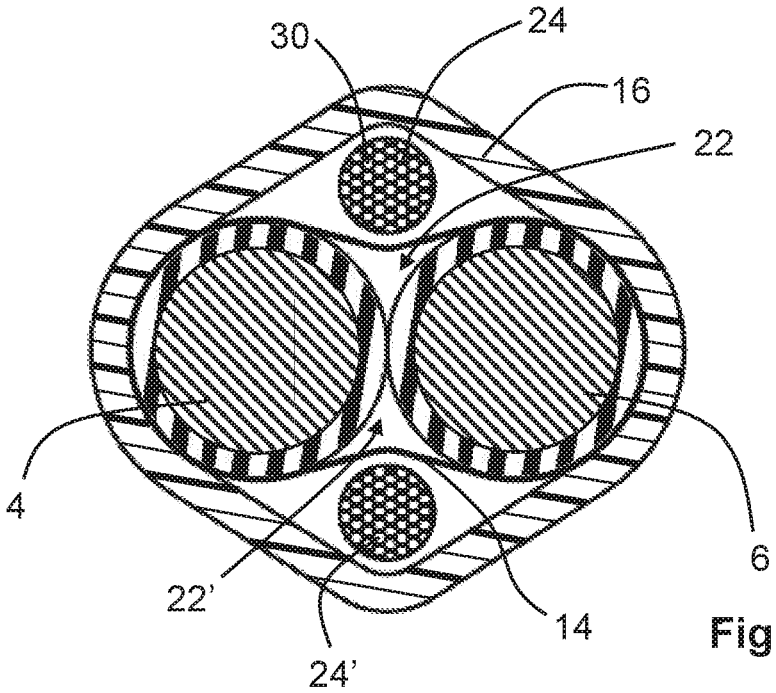

FIGS. 2*a* and 2*b* schematically illustrate a low voltage electric power cable 2 according to embodiments. These embodiments resemble in much the embodiments of FIGS. 1*a*-1*f*. Accordingly, mainly the differences with the embodiments of FIGS. 1*a*-1*f* will be discussed in the following.

Again, the low voltage electric power cable 2 comprises at least two insulated conductors 4, 6. The insulated conductors 4, 6 are arranged together in a bundle 10, and at least one foil 14 extends around the bundle 10. The low voltage electric power cable 2 comprises an elongated member 24 arranged between the foil 14 and an outer sheath 16. The elongated member 24 extends adjacent to the foil 14 along a recess 22 between two adjacent insulated conductors. The elongated member 24 is arranged with a clearance fit underneath the outer sheath 16.

In these embodiments, the low voltage electric power cable 2 comprises a further elongated member 24'. A further recess 22' is formed between two adjacent insulated conductors 4, 6, of the at least two insulated conductors 4, 6. The further recess 22' extends in parallel with the two adjacent insulated conductors 4, 6 along the length L. The further elongated member 24' is arranged with a clearance fit between the at least one foil 14 and the outer sheath 16, and extends adjacent to the at least one foil 14 along the further recess 22'.

Accordingly, the low voltage electric power cable 2 according to these embodiments comprises two elongated members 24, 24'. Thus, the cable 2 may be given a cross-sectional shape, which may be approximated with a circular shape, or an approximately square shape. Again, such different cross-sectional shapes may sometimes be desirable in a cable, e.g. in order to provide a seal against the cable when it is to extend through an opening.

Again, the clearance fit provides an easily bendable cable 2.

The clearance fit is achieved during manufacturing of the low voltage electric power cable 2 in the same manner as discussed above. That is, the at least one foil 14 is arranged to slide in a radial direction of the low voltage electric power cable 2 in relation to the at least two insulated conductors 4, 6. The at least one foil 14 is first arranged tight around the bundle 10 and the two elongated members 24, 24' being pressed against the at least one foil 14 cause the at least on foil 14 to give way into the recesses 22, 22' thus, providing a clearance between the outer sheath 16 and the two elongated members 24, 24' and the bundle 10.

According to embodiments, the at least two insulated conductors 4, 6, may be twisted about each other along the length L. In these embodiments the at least two insulated conductors extend in parallel with each other but not in parallel with the length L of the cable 2.

In comparison with a cable having parallel insulated conductors in parallel with the length L, a cable with twisted insulated conductors may be bent at a sharper angle. Accordingly, embodiments with twisted conductors may in some implementations be preferred when the cross sectional area of each conductive core of the insulated conductors 4, 6 is within an upper end of the above mentioned cross-sectional area range.

Again, edges of the at least one foil 14 extend in parallel with the at least two insulated conductors 4, 6. In these embodiments, wherein the at least two insulated conductors are twisted about each other, this entails that the at least one foil 14 is twisted with the same pitch as the at least two insulated conductors, and accordingly, the same pitch as the recesses 22, 22', within the cable 2. Thus, the edges of the at least one foil 14 extend at the same distance from the recesses 22, 22' along the length L of the cable 2. Therefore, the at least one foil 14, slidably arranged in relation to the at least two insulated conductors 4, 6, may slide in a radial direction of the cable 2 into the recesses 22, 22'.

The pitch defines the length along the cable that e.g. one insulated conductor extends in order to form one full revolution within the cable, similar to the pitch of a thread of a screw. Naturally, the cable 2 of FIGS. 1*a*-1*f* may alternatively be provided with insulated conductors, which are twisted about each other along the length L. Conversely, the cable 2 of FIGS. 2*a* and 2*b* may alternatively be provided with insulated conductors, which extend in parallel with each other and with the length L.

According to embodiments, the at least one foil 14 may comprise at least one metal layer. In this manner, the at least one foil 14 may form an electrically conductive shield of the low voltage electric power cable 2. In order to form a proper electromagnetic shield, suitably, the edges 26, 26' of the at least one foil 14 are circumferentially overlapping as shown in FIG. 1*e*. The metal layer may for instance comprise aluminium and/or copper.

The at least one foil 14 may comprise one, two, or more layers. According to some embodiments the at least one foil may comprise one layer only, e.g. one metal layer only, one polymer layer only, or one paper layer only. According to some embodiments, the at least one foil may comprise two layers, such as e.g. one metal layer and one polymer layer.

According to embodiments, the elongated member 24 may comprise at least one metal wire 30. In this manner, the elongated member 24 may form a shield wire, see FIG. 2*b*. The entire elongated member 24, and/or the further elongated member 24' in embodiments comprising a further elongated member 24', may be made from one or more metal wires 30. The one or more metal wires 30 may for instance comprise aluminium and/or copper. In embodiments comprising more than one metal wire 30, the individual metal wires 30 may be arranged to extend in parallel with each other and the length L. Alternatively, the individual metal wires 30 may be twisted about each other.

Together with the at least one foil 14 comprising at least one metal layer, the elongated member 24, and/or the further elongated member 24', comprising at least one metal wire 30 may form an electric shield of the low voltage electric power cable 2. Naturally, also in such embodiments, a purpose of the elongated member 24 is to achieve the clearance fit of the components within the outer sheath 16. A further purpose may be to lend the cable a cross-sectional shape, which resembles a circular shape.

According to some embodiments, the elongated member 24, or the elongated members 24, 24' if there is more than one elongated member, may have a common cross sectional area within a range of 5-80% of a cross sectional area of one of the at least two insulated conductors 4, 6.

FIGS. 3*a*-3*e* schematically illustrate cross sections through low voltage electric power cables 2 according to various embodiments. These embodiments resemble in much the embodiments of FIGS. 1*a*-2*b*. FIGS. 3*a*-3*e* are mainly provided to show further examples of cross sections of the insulated conductors, further numbers of insulated conductors, and different arrangements of elongated members. The examples are not limiting to the scope of protection, but further embodiments with different combinations of insulated conductors and elongated members are envisaged within scope of the appended claims.

Figure 3A:
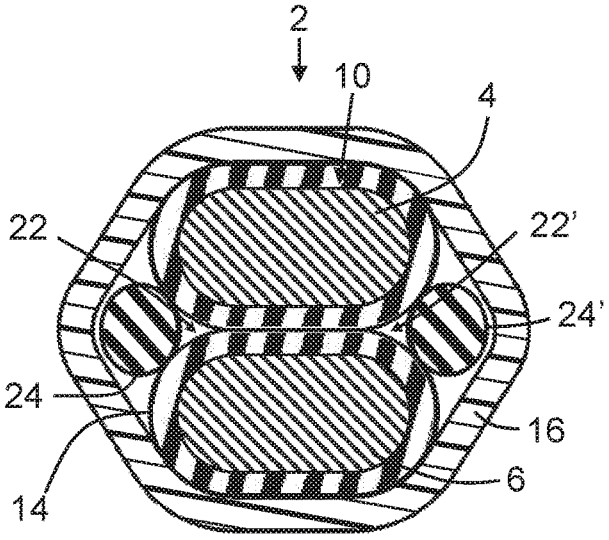

FIG. 3*a* shows a cable 2 comprising two insulated conductors 4, 6, each one having an oval cross section. Again, the insulated conductors 4, 6 are arranged together in a bundle 10, and at least one foil 14 extends around the bundle 10. The cable 2 comprises an elongated member 24 arranged between the foil 14 and an outer sheath 16. The elongated member 24 extends adjacent to the foil 14 along a recess 22 between two adjacent insulated conductors. The elongated member 24 is arranged with a clearance fit underneath the outer sheath 16. A further elongated member 24' is arranged with a clearance fit between the at least one foil 14 and the outer sheath 16, and extends adjacent to the at least one foil 14 along the further recess 22'.

Figure 3B:
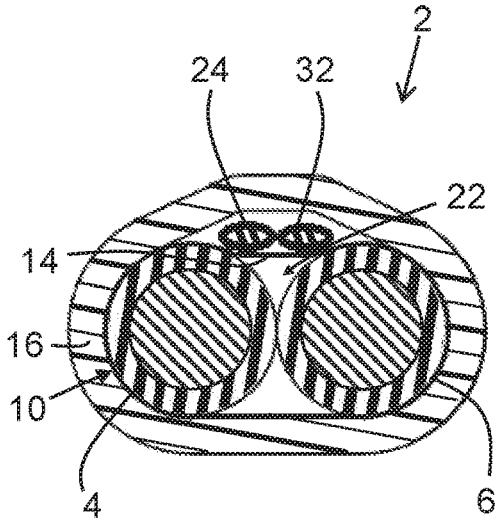

FIG. 3*b* shows a cable 2 comprising two insulated conductors 4, 6 arranged together in a bundle 10, and at least one foil 14 extending around the bundle 10. The cable 2 comprises two elongated members 24, 32, arranged between the foil 14 and the outer sheath 16. The two elongated members 24, 32 extend adjacent to the foil 14 along the recess 22. The two elongated members 24, 32 each have an oval cross section. The two elongated members 24, 32 are arranged with a clearance fit underneath the outer sheath 16.

Figure 3C:
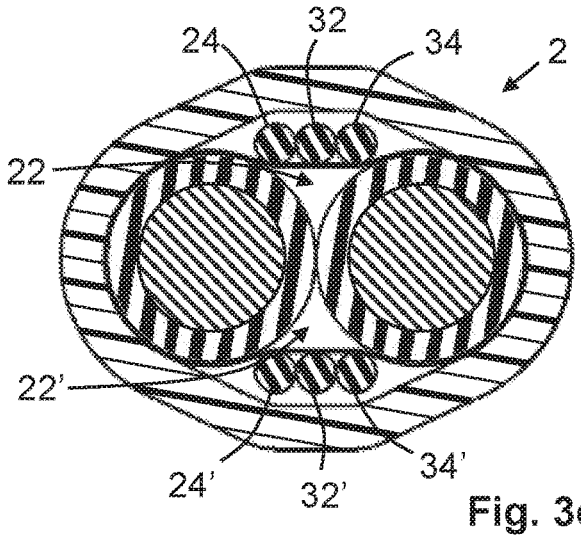

FIG. 3*c* shows a cable 2 comprising three elongated members 24, 32, 34 arranged adjacent to the foil 14 along the recess 22. Three further elongated members 24', 32', 34' are arranged adjacent to the at least one foil 14 along a further recess 22' opposite to the recess 22. All elongated members 24, 32, 34, 24', 32', 34' are arranged with a clearance fit underneath the outer sheath 16.

Figure 3D:
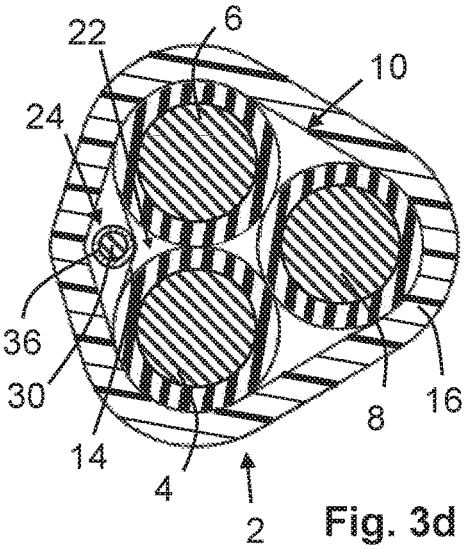

FIG. 3*d* shows a cable 2 comprising three insulated conductors 4, 6, 8 arranged together in a bundle 10, and at least one foil 14 extends around the bundle 10. The cable 2 comprises an elongated member 24 arranged between the at least one foil 14 and an outer sheath 16. The elongated member 24 extends adjacent to the foil 14 along a recess 22 between two adjacent insulated conductors 4, 6 of the three insulated conductors 4, 6, 8. The elongated member 24 is arranged with a clearance fit underneath the outer sheath 16. According to some embodiments, the elongated member 24 may comprises an outer polymer layer 36 extending around the at least one metal wire 30, as indicated in FIG. 3*d*. In this manner, the elongated member 24 may form a conductor of the cable 2. If the outer polymer layer 36 is an insulating layer, the elongated member 24 may form e.g. a ground or neutral conductor of the cable 2. If the outer polymer layer 36 has semiconducting or conducting properties, the elongated member 24 may form e.g. a shield wire of the cable 2.

Figure 3E:
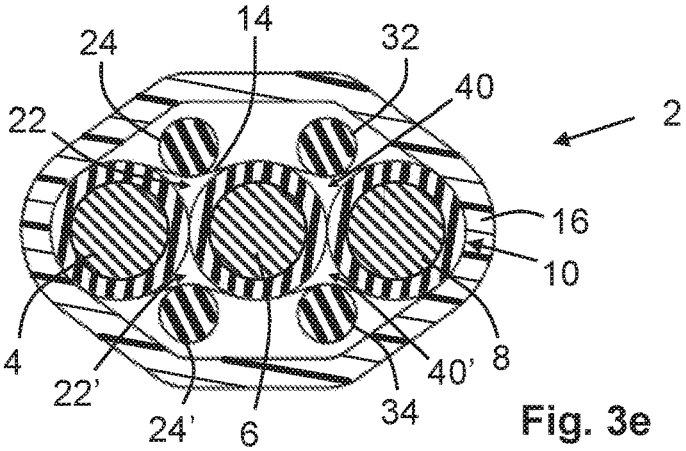

FIG. 3*e* shows a cable 2 comprising three insulated conductors 4, 6, 8 arranged together in a bundle 10, and at least one foil 14 extends around the bundle 10. The cable 2 comprises four elongated members 24, 24', 32, 34 arranged between the foil 14 and an outer sheath 16. The elongated members 24, 24', 32, 34 extend adjacent to the foil 14 along four recesses 22, 22', 40, 40' between respective of two adjacent insulated conductors 4, 6, 8 of the three insulated conductors 4, 6, 8. The elongated members 24, 24', 32, 34 are arranged with a clearance fit underneath the outer sheath 16.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the invention, as defined by the appended claims. For instance, the cable 2 may comprise more than three insulated conductors, such as four, five, or more insulated conductors.

The invention claimed is:

1. A low voltage electric power cable having a length and comprising at least two insulated conductors arranged together in a bundle, at least one foil extending around the bundle, and an outer sheath extending around the at least one foil, wherein each of the at least two insulated conductors includes a conductive core and an outer electrically insulating layer, wherein the at least two insulated conductors are arranged adjacent to each other along the length, wherein a recess is formed between two adjacent insulated conductors of the at least two insulated conductors, the recess extending in parallel with the two adjacent insulated conductors along the length, wherein the low voltage electric power cable includes an elongated member, the elongated member being arranged between the at least one foil and the outer sheath, and extending adjacent to the at least one foil along the recess, wherein the elongated member is arranged with a clearance fit underneath the outer sheath, wherein the at least one foil is slidable in relation to the at least two insulated conductors in a radial direction of the cable, and wherein a clearance between the elongated member and the outer sheath is at least 0.05 mm when the elongated member abuts against the at least one foil and is supported against each of the two adjacent insulated conductors of the at least two insulated conductors.

2. The low voltage electric power cable according to claim 1, wherein edges of the at least one foil extend in parallel with the at least two insulated conductors.

3. The low voltage electric power cable according to claim 2, wherein a clearance between the elongated member and the outer sheath is at least 0.05 mm when the elongated member abuts against the at least one foil and is supported against each of the two adjacent insulated conductors of the at least two insulated conductors.

4. The low voltage electric power cable according to claim 2, wherein the at least one foil includes at least one metal layer.

5. The low voltage electric power cable according to claim 2, wherein edges of the at least one foil are arranged circumferentially overlapping.

6. The low voltage electric power cable according to claim 2, wherein the elongated member includes at least one metal wire.

7. The low voltage electric power cable according to claim 2, wherein the elongated member includes an outer polymer layer extending around the at least one metal wire.

8. The low voltage electric power cable according to claim 2, wherein the elongated member is formed of an electrically insulating material.

9. The low voltage electric power cable according to claim 2, wherein the at least two insulated conductors are twisted about each other along the length.

10. The low voltage electric power cable according to claim 2, including a further elongated member, wherein a further recess is formed between two adjacent insulated conductors of the at least two insulated conductors, the further recess extending in parallel with the two adjacent insulated conductors along the length, and wherein the further elongated member is arranged with a clearance fit between the at least one foil and the outer sheath, and extends adjacent to the at least one foil along the further recess.

11. The low voltage electric power cable according to claim 1, wherein the at least one foil includes at least one metal layer.

12. The low voltage electric power cable according to claim 1, wherein edges of the at least one foil are arranged circumferentially overlapping.

13. The low voltage electric power cable according to claim 1, wherein the elongated member includes at least one metal wire.

14. The low voltage electric power cable according to claim 1, wherein the elongated member includes an outer polymer layer extending around the at least one metal wire.

15. The low voltage electric power cable according to claim 1, wherein the elongated member is formed of an electrically insulating material.

16. The low voltage electric power cable according to claim 1, wherein the at least two insulated conductors extend in parallel with each other and the length.

17. The low voltage electric power cable according to claim 1, wherein the at least two insulated conductors are twisted about each other along the length.

18. The low voltage electric power cable according to claim 1, including a further elongated member, wherein a further recess is formed between two adjacent insulated conductors of the at least two insulated conductors, the further recess extending in parallel with the two adjacent insulated conductors along the length, and wherein the further elongated member is arranged with a clearance fit between the at least one foil and the outer sheath, and extends adjacent to the at least one foil along the further recess.

19. The low voltage electric power cable according to claim 1, wherein the two insulated conductors are configured to distribute electric power of up to 1 kV.

20. A low voltage electric power cable having a length and comprising at least two insulated conductors arranged together in a bundle, at least one foil extending around the bundle, and an outer sheath extending around the at least one foil, wherein each of the at least two insulated conductors includes a conductive core and an outer electrically insulating layer, wherein the at least two insulated conductors are arranged adjacent to each other along the length, wherein a recess is formed between two adjacent insulated conductors of the at least two insulated conductors, the recess extending in parallel with the two adjacent insulated conductors along the length, wherein the low voltage electric power cable includes an elongated member, the elongated member being arranged between the at least one foil and the outer sheath, and extending adjacent to the at least one foil along the recess, wherein an entire perimeter of the elongated member is arranged with a clearance fit relative to the outer sheath, and wherein the at least one foil is slidable in relation to the at least two insulated conductors in a radial direction of the cable.

* * * * *